US006457888B1

(12) United States Patent
Matsumoto

(10) Patent No.: US 6,457,888 B1
(45) Date of Patent: Oct. 1, 2002

(54) SHEET CONVEYING APPARATUS

(75) Inventor: Toshiya Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/636,637

(22) Filed: Aug. 11, 2000

(30) Foreign Application Priority Data

Aug. 20, 1999 (JP) ..... 11-234696

(51) Int. Cl.[7] ..... B41J 13/10
(52) U.S. Cl. ..... 400/625; 400/645
(58) Field of Search ..... 400/625, 624, 400/645; 347/4, 104

(56) References Cited

U.S. PATENT DOCUMENTS 5,291,224 A * 3/1994 Asano et al. ..... 101/425
5,441,354 A * 8/1995 Broder et al. ..... 400/638
5,738,454 A * 4/1998 Zepeda et al. ..... 400/638
5,807,003 A * 9/1998 Kobayashi et al. ..... 400/625
5,993,094 A * 11/1999 Lee ..... 400/625

FOREIGN PATENT DOCUMENTS

DE 27 34 041 10/1978
JP 56-148585 11/1981
JP 62-211260 9/1987
JP 09-086749 3/1997

* cited by examiner

*Primary Examiner*—Andrew H. Hirshfeld
*Assistant Examiner*—Anthony H. Nguyen
(74) *Attorney, Agent, or Firm*—Fitzpatrick, Cella, Harper & Scinto

(57) ABSTRACT

A sheet discharging apparatus and an image forming apparatus having the sheet discharging apparatus in which a sheet can be discharged without causing any spur trace on the surface of the sheet. Therefore, a sheet P having an image formed thereon is discharged to a sheet discharging section by sheet discharging device 502, 503 and rotary members 504, 505. A plurality of projections 504*a*, 505*a* are respectively formed on outer circumferential portions of the rotary members 504, 505. The rotary members 504, 505 are rotated by rotation of the sheet discharging device 502, 503 while the sheet P is pressed by the projections 504*a*, 505*a*. When the rotary members 504, 505 are rotated while pressing the sheet P, orientations of the rotary members 504, 505 are changed by an attitude changing device in accordance with a movement of the sheet P so that rotating directions of the rotary members 504, 505 are made coincide with a discharging direction of the sheet P.

14 Claims, 10 Drawing Sheets

SHEET CONVEYING APPARATUS

BACKGROUND OF THE INVENTION

1. Field of the Invention

The present invention relates to a sheet conveying apparatus. More particularly, the present invention relates to a sheet discharging apparatus as the sheet conveying apparatus, and an image forming apparatus having this sheet discharging apparatus in which a sheet having an image formed thereon is discharged by sheet discharging means and a rotary member rotated by a rotation of the sheet discharging means while the sheet is pressed by the rotary member.

2. Related Background Art

In one example of the image forming apparatus, there is conventionally known a recorder such as a printer, a copying machine, a facsimile, or a recorder used as an output device for a composite type electronic device including a computer, a word processor, etc. or a work station. Such a recorder is constructed such that an image is recorded to a recording material (hereinafter referred to as a sheet) such as a sheet of paper, a plastic thin plate on the basis of image information.

Here, such a recorder is divided into a serial type using a serial scan system for performing a main scanning operation in a direction crossing a conveying direction (sub-scanning direction) of the sheet, and a line type in which the image is recorded by only the sub-scan in the conveying direction of the sheet.

In the recorder of the serial type, the image is recorded (mainly scanned) by recording means mounted on a carriage which can move along the sheet. After the image is completely recorded on one line, the sheet is fed (pitch conveyance) by a predetermined amount. Thereafter, an image on the next line is recorded (mainly scanned) with respect to the sheet again stopped. Such an operation is repeated so that the recording operation of the entire sheet is performed.

In the recorder of the line type, the sheet is set to a predetermined recording position and the recording operation on one line is collectively performed. Thereafter, the sheet is fed (pitch conveyance) by a predetermined amount, and the recording operation on the next line is further collectively performed. Such an operation is repeated so that the recording operation of the entire sheet is performed.

There are an ink jet system, a wire dot system, a thermal system, a laser beam system, etc. as a recording system of such a recorder. When the ink jet system for performing the recording operation by discharging ink from the recording means (recording head) to the sheet by utilizing thermal energy is used, the recording means is easily made compact and a high definition image can be recorded at high speed.

Further, running cost is inexpensive and noises are small since the ink jet system is a non-impact system. Furthermore, it is easy to record a color image by using ink of many colors. Especially, in the case of a line type using the recording means of the line type in which many discharging ports are arranged in a sheet width direction, the recording operation can be performed at higher speed.

Further, the recording means (recording head) with a structure having a liquid path arrangement (discharging port arrangement) of high density can be easily manufactured by using an electrothermal converting member, an electrode, a liquid path wall, a top plate, etc., which are formed on a substrate, through semiconductor manufacturing processes of etching, evaporation, sputtering, etc. so that the recorder can be made further compact. Furthermore, the recording means is easily elongated and sheet-shaped (two-dimensionally constructed), and is fully multiplied and mounted at high density by practically using the advantages of an IC technique and a micro processing technique.

For example, as described in Japanese Patent Application Laid-Open No. 56-148585, coated paper is often used as a sheet for coping with coloring, an improvement in image quality and an increase in operating speed of such a recorder. In the coated paper, an ink receiving layer is formed on basic paper having an ink absorbing property by using a porous inorganic pigment.

In the coated paper having such an ink receiving layer, it is possible to obtain a clear image with high image density and high resolution, and sufficiently cope with an increase in speed of a print output. For example, silica disclosed in Japanese Patent Application Laid-Open No. 56-185690 is used as the porous inorganic pigment for forming such an ink receiving layer, and has an excellent coloring property.

In the recorder using such an ink jet system, the sheet fed by feeding means is held by a platen in a recording region, and an image is recorded to the sheet by the recording head. Thereafter, the sheet is discharged by a sheet discharging apparatus arranged downstream of the recording head in the conveying direction.

Here, as this sheet discharging apparatus, there is one having a structure constructed of a sheet discharging roller and a spur arranged opposite to the sheet discharging roller and rotated by a rotation of the sheet discharging roller while the spur is pressed against the sheet. FIG. 9 is a view showing an attaching state of the spur constituting such a sheet discharging apparatus. A plurality of sharp projections 1*a* for reducing a contact area with the sheet are formed into serration on an outer circumference of this spur 1. The projections 1*a* come in contact with the sheet in this way, and the contact area with the sheet is reduced so that indentation onto the sheet on which unfixed ink is deposited just after printing, and an ink mark are restrained.

The spur 1 is attached to a base member 3 such that the spur 1 is rotated with an elastic shaft 2 as a center, and obtains pressing force against the sheet by the elastic shaft 2. Further, the spur 1 is regulated by thrust regulating walls 3*a*, 3*b*, 3*c*, 3*d* of the base member 3 such that a rotating direction of the spur 1 is in conformity with a discharging direction A of the sheet.

However, in such a conventional sheet discharging apparatus, there is a case in which the thrust regulating walls 3*a*, 3*b*, 3*c*, 3*d* of the base member 3 are slantingly deviated from the discharging direction A of the sheet so that the rotating direction of the spur 1 and the sheet discharging direction A are deviated from each other by an angle θ as shown in FIG. 10. There is also a case in which a projecting portion 3*e* is formed by a burr, indentation, etc. in the thrust regulating wall 3*c* as shown in FIG. 11. In other words, there is a case in which no rotating direction of the spur 1 is perfectly in conformity with the sheet discharging direction A by shape deformation or skew feed of the sheet, etc. due to an accuracy in parts and a change in environment.

When no rotating direction of the spur 1 is perfectly in conformity with the sheet discharging direction A, a tip of one projection 1*a* of the spur 1 is deviated in a direction perpendicular to the sheet discharging direction A until the tip of one projection 1*a* of the spur 1 is separated from a printing surface of the sheet after this tip comes in contact with the printing surface. Therefore, when the coated paper having a soft surface layer is particularly printed, there is a case in which the ink receiving layer on the surface is separated and a spur trace is caused in a white dot shape on a printing surface.

SUMMARY OF THE INVENTION

In consideration of such a situation, an object of the present invention is to provide a sheet discharging apparatus and an image forming apparatus having the sheet discharging apparatus in which a sheet can be discharged without causing any spur trace on a surface of the sheet.

According to the present invention, there is provided a sheet discharging apparatus for discharging a sheet having an image formed thereon to a sheet discharging section, the apparatus comprising: sheet discharging means for discharging the sheet to the sheet discharging section; a rotary member having a plurality of projections formed on an outer circumferential portion thereof, the rotary member being rotated by a rotation of the sheet discharging means while pressing the sheet by the projections; and attitude changing means that changes an orientation of the rotary member in accordance with a movement of the sheet so that, when the rotary member is rotated while pressing the sheet, a rotating direction of the rotary member is in conformity with a discharging direction of the sheet.

Further according to the present invention, there is provided a sheet discharging apparatus, wherein the attitude changing means includes a retaining member for oscillatably retaining the rotary member, and regulating members, which are opposingly arranged on both sides of the rotary member while abutting against the rotary member, for regulating an axial movement of the rotary member, and wherein the regulating members are constructed in such a manner that the regulating members abut against the rotary member upstream of a contact point of the rotary member with the sheet in the sheet discharging direction so that an oscillation center of the rotary member is located upstream of the contact in the sheet discharging direction.

Still further, according to the present invention, there is provided a sheet discharging apparatus, wherein a distance between the regulating members opposingly arranged is gradually increased from an upstream side to a downstream side in the sheet discharging direction so that the oscillation center of the rotary member is located upstream of the contact point in the sheet discharging direction.

Yet further, according to the present invention, there is provided a sheet discharging apparatus, wherein projecting portions abutting against the rotary member are provided on the opposed regulating members upstream of the contact point in the sheet discharging direction so that the oscillation center of the rotary member is located on the upstream side in the sheet discharging direction from the contact point.

Yet still further, according to the present invention, there is provided a sheet discharging apparatus, wherein the distance between the regulating members opposingly arranged on the upstream side of the contact point in the sheet discharging direction is narrowed in comparison with the distance on the downstream side so that the oscillation center of the rotary member is located upstream of the contact point in the sheet discharging direction.

Further, according to the present invention, there is provided a sheet discharging apparatus, wherein the rotary member is rotated about an elastic shaft as a center, and is oscillatably retained by the retaining member through the elastic shaft.

Still further, according to the present invention, there is provided a sheet discharging apparatus, wherein the attitude changing means includes an oscillation member for rotatably retaining the rotary member, a retaining member for oscillatably retaining the oscillation member, and regulating members, which are opposingly arranged on both sides of the oscillation member while abutting against the oscillation member, for regulating an axial movement of the oscillation member; and wherein the regulating members are constructed in such a manner that the regulating members abut against the oscillation member upstream of a contact point of the rotary member with the sheet in the sheet discharging direction so that an oscillation center of the oscillation member is located upstream of the contact point in the sheet discharging direction.

Yet further, according to the present invention, there is provided a sheet discharging apparatus for discharging a sheet having an image formed thereon to a sheet discharging section, the apparatus comprising: sheet discharging means for discharging the sheet to the sheet discharging section; a rotary member having a plurality of projections formed on an outer circumferential portion thereof, the rotary member being rotated by a rotation of the sheet discharging means while pressing the sheet by the projections; and supporting means for supporting the rotary member so that, when the rotary member is rotated while pressing the sheet, an orientation of the rotary member is changed in accordance with a moving direction of the sheet.

Yet still further, according to the present invention, there is provided an image forming apparatus comprising an image forming section and a sheet discharging apparatus for discharging a sheet having an image formed in the image forming section to a sheet discharging section, the sheet discharging apparatus comprising one as set forth in any one of the above apparatus.

Furthermore, according to the present invention, a sheet having an image formed thereon is discharged to a sheet discharging section by sheet discharging means and a rotary member having a plurality of projections formed on an outer circumferential portion of the rotary member, the rotary member being rotated by a rotation of the sheet discharging means while pressing the sheet. When the rotary member is rotated while pressing the sheet, an orientation of the rotary member is changed by attitude changing means in accordance with a movement of the sheet so that the rotating direction of the rotary member is made coincide with a discharging direction of the sheet.

DESCRIPTION OF THE PREFERRED EMBODIMENTS

Embodiments of the present invention will next be described in detail with reference to the attaching drawings.

Figure 1:
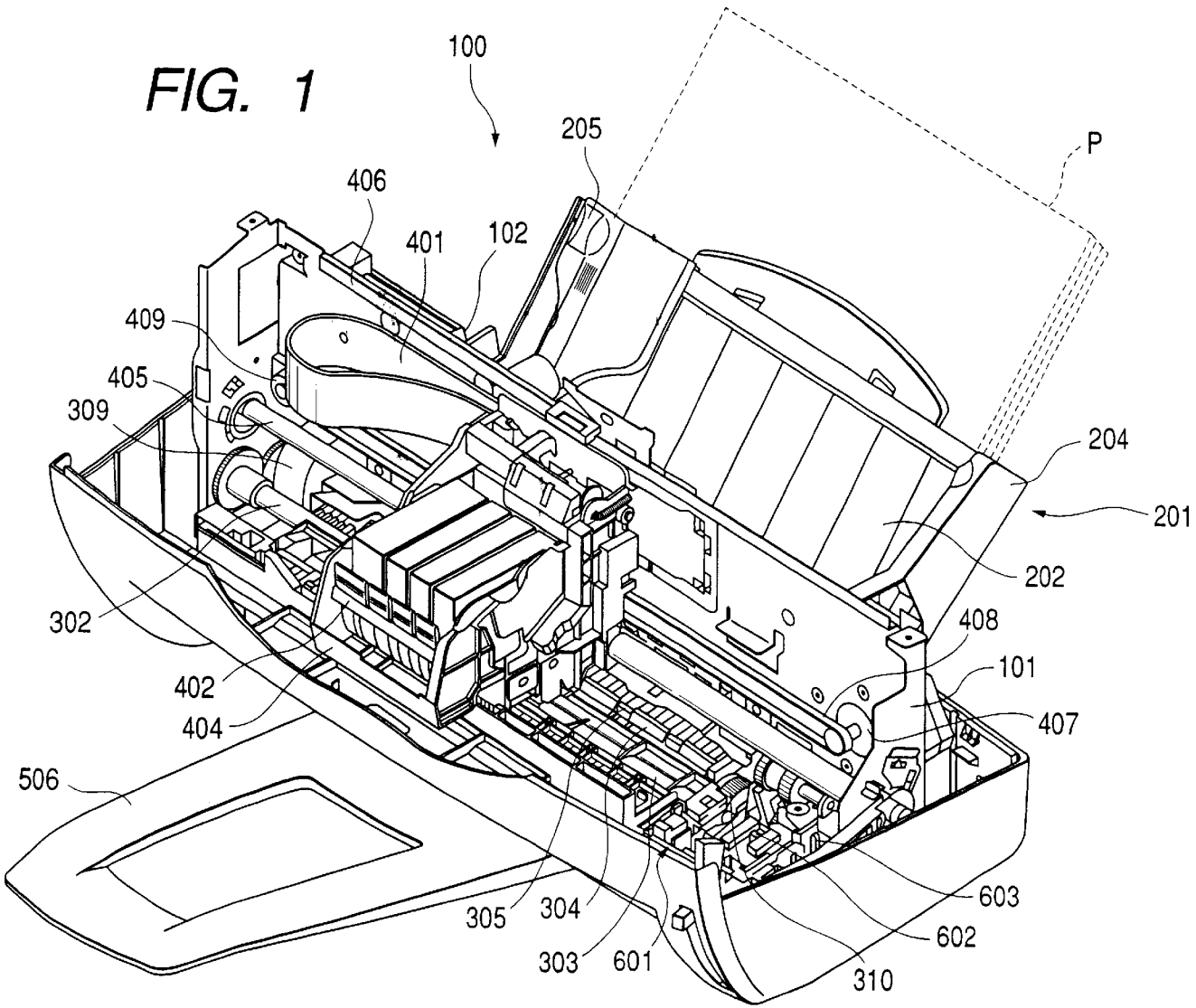
FIG. 1 is a perspective view showing an entire structure of a recorder as an example of an image forming apparatus in accordance with a first embodiment of the present invention.
Figure 2:
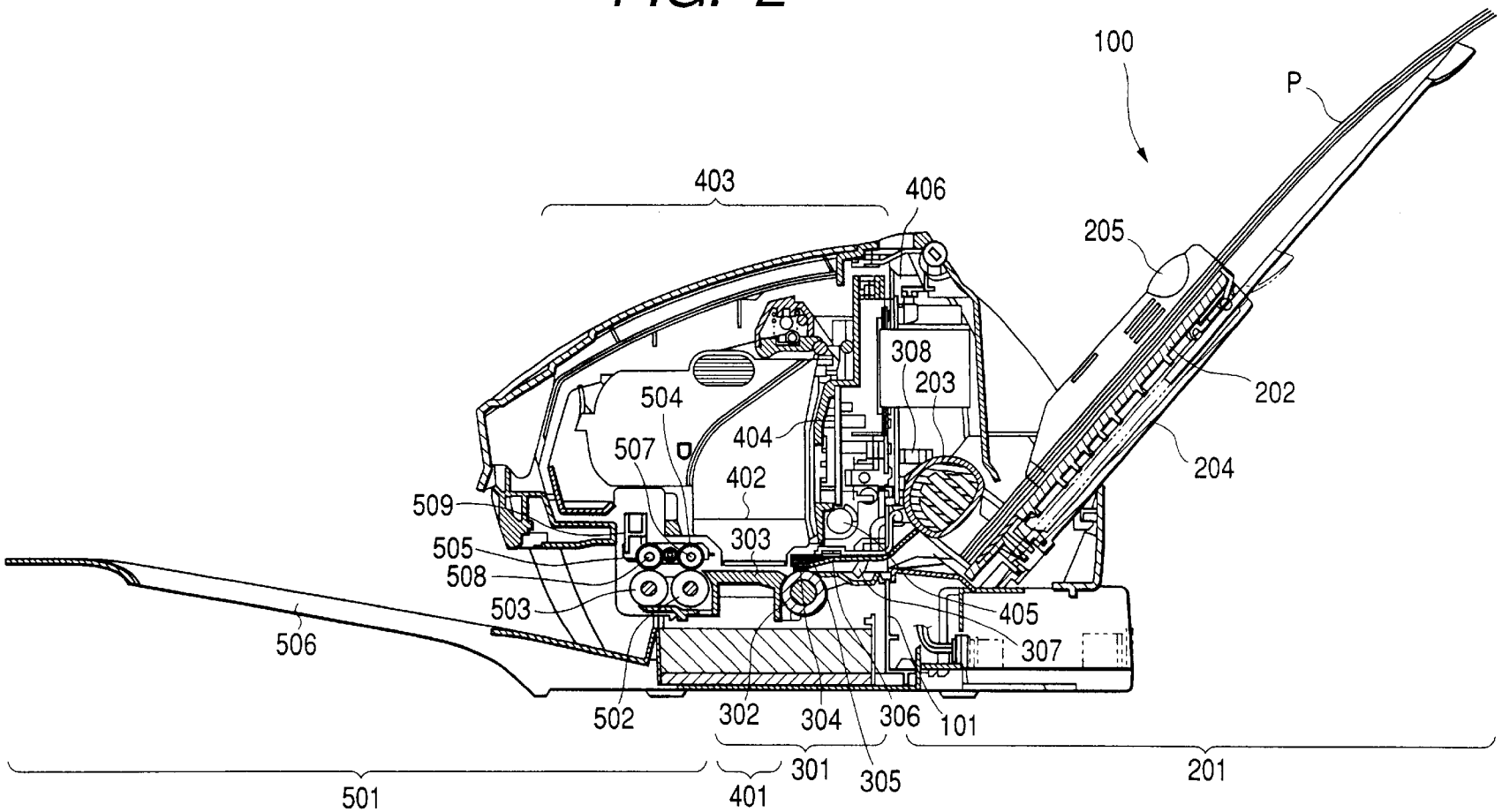
FIG. 2 is a cross-sectional view showing the entire structure of the recorder.

FIG. 1 is a perspective view showing the entire structure of a recorder as one example of an image forming apparatus in accordance with a first embodiment of the present invention. FIG. 2 is a cross-sectional view showing the entire structure of the recorder.

In FIGS. 1 and 2, reference numeral 100 designates a recorder of an ink jet system. The recorder 100 is constructed of a feeding section 201, a conveying section 301, a recording section 401, a sheet discharging section 501 and a cleaning section 601.

The feeding section 201 is constructed such that a pressure plate 202 for slantingly stacking plural sheets P and a feeding rotary member 203 for feeding the sheets P are attached to a base 204. A movable side guide 205 is arranged in the pressure plate 202 such that the movable side guide 205 can be moved leftward and rightward. Stacking positions of the sheets P in left and right directions are regulated by the movable side guide 205. An unillustrated separating means for separating the sheets P one by one and an unillustrated feed releasing means are arranged in the feeding section 201. The feed releasing means makes the pressure plate 202 come in contact with the feeding rotary member 203, and separates the pressure plate 202 from the feeding rotary member 203.

Figure 3:
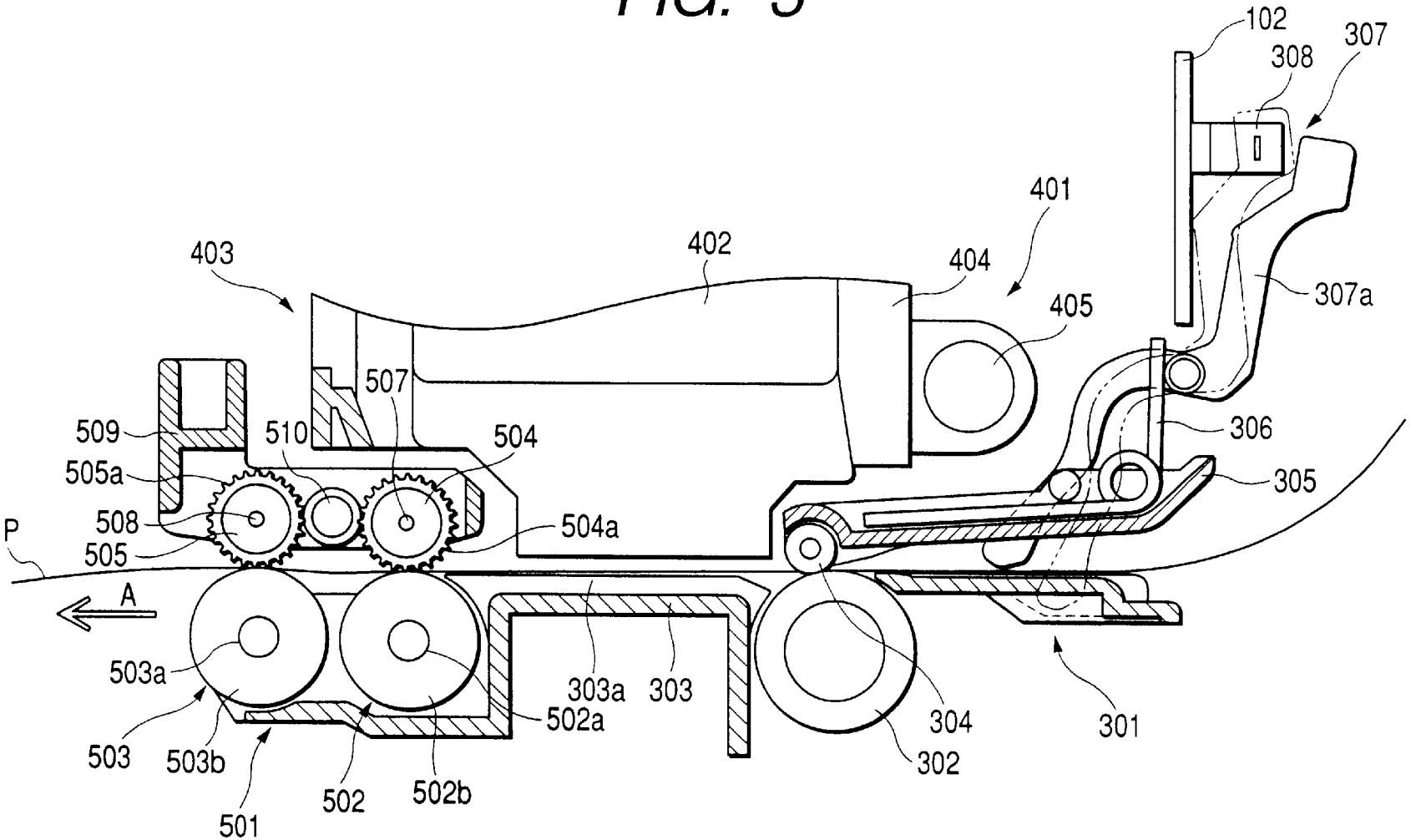
FIG. 3 is an enlarged sectional view showing portions near a conveying portion and a sheet discharging portion of the recorder.
Figure 4:
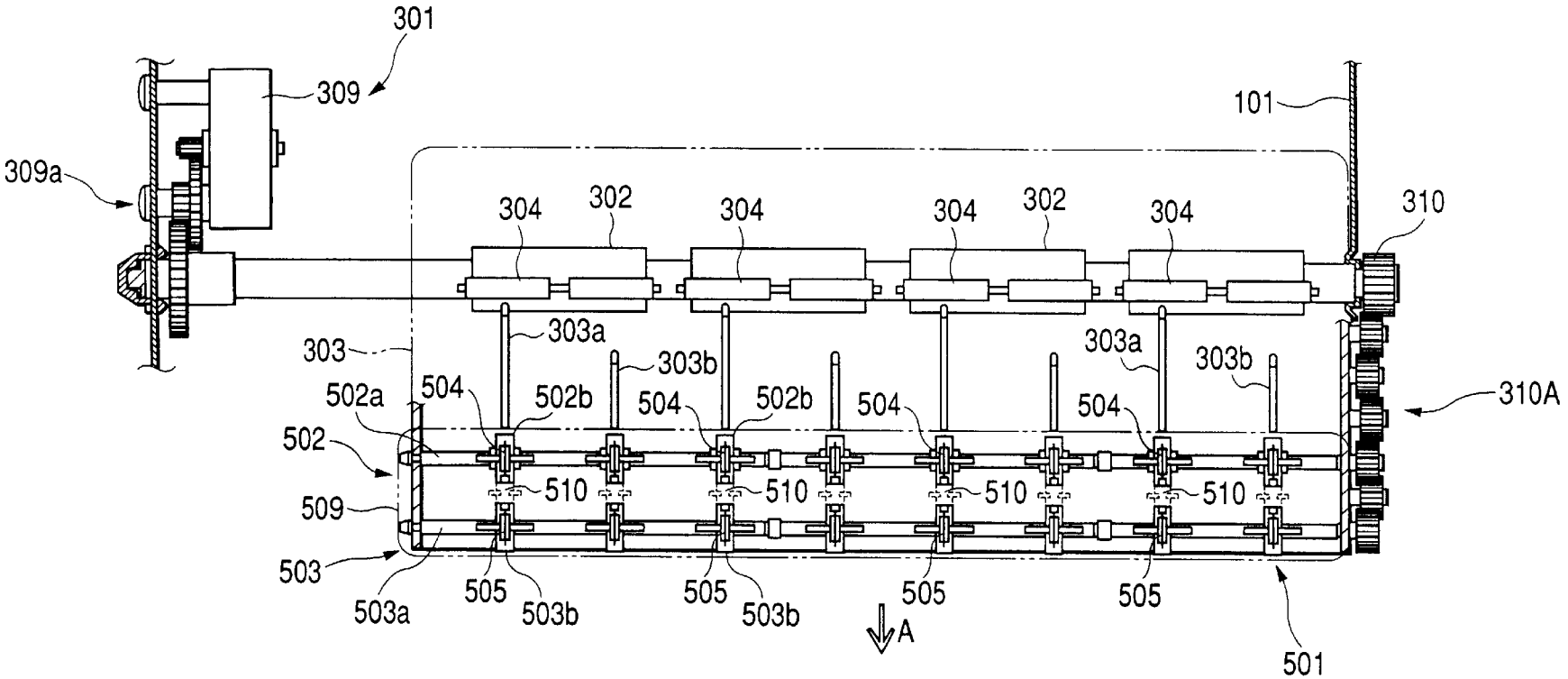
FIG. 4 is a schematic view in which the portions near the conveying portion and the sheet discharging portion of the recorder are seen from above the recorder.

As shown in FIGS. 3 and 4, the conveying section 301 has a conveying roller 302, a platen 303 and sheet end detecting means (hereinafter referred to as PE detecting means) 307. The conveying roller 302 constitutes conveying means for conveying a sheet P. The platen 303 has ribs 303*a*, 303*b* for setting the distance between the sheet P and a recording head 402 described later.

A driving output from a sheet feeding motor 309 is deceleration-transmitted to the conveying roller 302 by a suitable gear system 309*a*. A pinch roller 304 abuts against the conveying roller 302 and is moved by frictional driving force of the conveying roller 302 and the sheet P.

Here, the pinch roller 304 is held by a pinch roller holder 305 biased toward the conveying roller 302 by a pinch roller spring 306. Thus, the pinch roller 304 comes in press contact with the conveying roller 302 and conveying force of the sheet P is generated. The platen 303 and the pinch roller holder 305 are extended to guide the sheet P as far as a position near an inlet of the conveying section 301 in which the sheet P is conveyed.

The PE detecting means 307 is constructed of a PE lever 307*a* and a PE sensor 308. A rotating angle of the PE lever 307*a* is changed in accordance with existence and nonexistence of the sheet P. The PE sensor 308 converts a light-shielding/light-opening state into an electric signal by the change in the rotating angle of the PE lever 307*a* at its paper passing opposite end.

The recording section 401 as an image forming section or image forming means is arranged downstream of the conveying roller 302 in the sheet conveying direction. This recording section 401 has a recording head 402 for forming an image on the basis of image information, and a carriage section 403 having a carriage 404 for detachably holding the recording head 402.

The carriage 404 of the carriage section 403 is supported by a guide shaft 405 and a guide rail 406. The guide shaft 405 is arranged to reciprocate the carriage 404 in scanning in a direction (main scanning direction) perpendicular to a conveying direction of the sheet P. The guide rail 406 is arranged in a chassis 101 as shown in FIG. 1 to hold a rear end of the carriage 404 and maintain the distance between the recording head 402 and the sheet P. Incidentally, the guide shaft 405 is attached to the chassis 101. Further, the 4guide rail 406 is formed by bending an upper portion of the chassis 101 in a Z-shape, and is formed integrally with the chassis 101.

As shown in FIG. 1, the carriage 404 is linearly driven by a carriage motor 407 attached to the chassis 101 through a timing belt 408. This timing belt 408 is tensioned by an idle pulley 409. Further, the carriage 404 has an FFC cable 410 for transmitting a signal from an electric substrate 102 to the recording head 402.

The recording head 402 has an unillustrated electrothermal converting member such as a heater, etc. for generating thermal energy for discharging ink. A film of the ink is boiled by the thermal energy applied by this electrothermal converting member. The ink is discharged from an unillustrated nozzle (ink discharging port) of the recording head 402 by a change in pressure caused by the growth or shrinkage of air bubbles due to the film boiling so that an image is formed on the sheet P.

As shown in FIGS. 3 and 4, the sheet discharging section 501 is arranged downstream of the recording section 401. The sheet discharging section 501 discharges the sheet P to which the image is completely recorded. Further, the sheet discharging section 501 stabilizes a behavior of the sheet P during the image recording, and is constructed of a sheet discharging apparatus having two sheet discharging rollers 502, 503 as first rotary members or sheet discharging means, plural spurs 504, 505 as second rotary members or rotary members, a spur base 509 as a retaining member, a sheet discharging tray 506 (see FIG. 1) as a sheet discharging section, etc. The sheet discharging rollers 502, 503 are arranged in parallel with the conveying roller 302. The spurs 504, 505 are rotated by a movement of the sheet while these spurs press against the sheet P. The spur base 509 is fixed to the platen 303 and supports the spurs, etc. The sheet discharging tray 506 stacks the discharged sheet P.

The sheet discharging rollers 502, 503 respectively have shaft portions 502*a*, 503*a* and plural rubber roller portions 502*b*, 503*b* press-fitted onto the shaft portions 502*a*, 503*a* or molded integrally with these shaft portions. These rubber roller portions 502*b*, 503*b* are arranged downstream of ribs 303*a*, 303*b* of the platen 303.

These sheet discharging rollers 502, 503 are constructed such that the shaft portions 502*a*, 503*a* are attached to the platen 303 by a snap fit and driving force is transmitted from a drive output gear 310 arranged at one end of the conveying roller 302 to the sheet discharging rollers 502, 503 through a suitable gear series 310A.

Further, the spurs 504, 505 are arranged in positions opposed to the respective rubber roller portions 502*b,* 503*b* of the sheet discharging rollers 502, 503. These spurs 504, 505 are respectively rotated by the sheet discharging rollers 502, 503 while the spurs 504, 505 press against the sheet P. Peripheral speeds of the sheet discharging rollers 502, 503 are higher than that of the conveying roller 302. A conveying speed of the sheet is approximately equal to the peripheral speed of the conveying roller 302. The sheet discharging rollers 502, 503 give conveying force to the sheet while they are slipped with respect to the sheet P.

Figure 5:
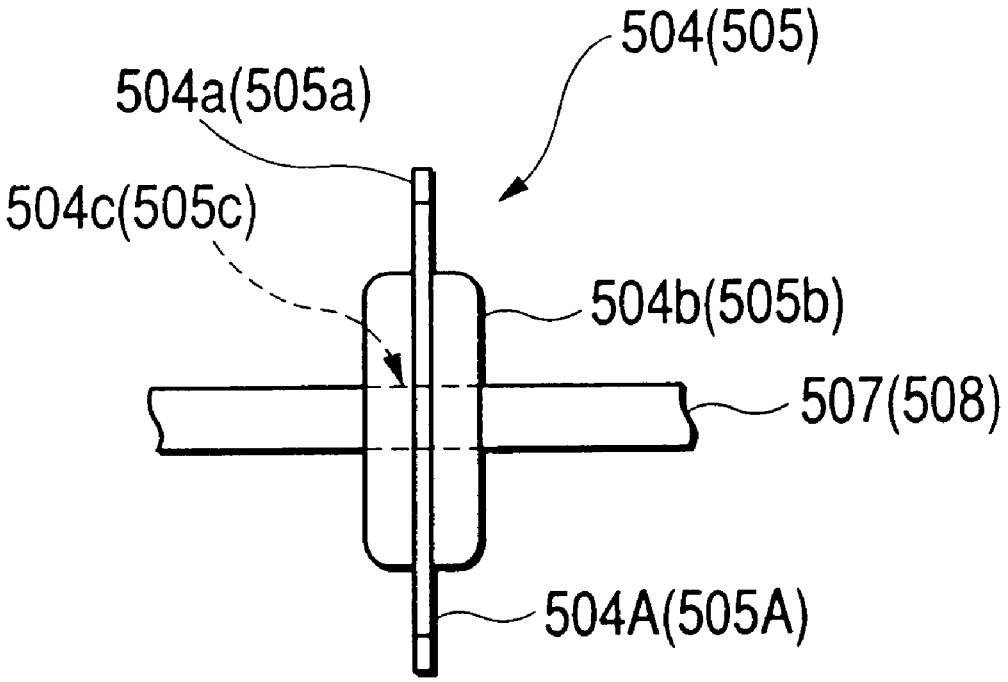
FIG. 5 is a view for explaining the structure of a spur of a sheet discharging apparatus constituting the sheet discharging portion.

The spurs 504, 505 respectively have sharp projections 504*a,* 505*a* on their outer circumferences to restrain indentations and ink marks onto the sheet P on which unfixed ink is deposited just after printing. These projections 504*a,* 505*a* are respectively formed into serration on the outer circumferences of thin disk portions 504A, 505A shown in FIG. 5. Water repellent finishing is performed on blade edge surfaces of the projections 504*a,* 505*a*. Incidentally, SUS having about 0.1 mm in plate thickness, etc. are preferably used as the thin disk portions 504A, 505A.

The thin disk portions 504A, 505A are respectively nipped by retaining portions 504*b,* 505*b* formed of resin (e.g., POM, etc.) having a preferable sliding property. Hole portions 504*c,* 505*c* are respectively formed in central portions of the retaining portions 504*b,* 505*b*. Spring shafts 507, 508 as supporting means for supporting the spurs 504, 505 are respectively inserted into these hole portions 504*c,* 505*c* such that orientations of the spurs 504, 505 are changed in accordance with a movement of the sheet P when the spurs 504, 505 are rotated while the spurs 504, 505 press against the sheet P.

Here, the spring shafts 507, 508 are elastic shafts each formed by winding a wire rod of SUS, etc. in a coil shape, and respectively have outside diameters slightly smaller than inside diameters of the hole portions 504*c,* 505*c* of the spurs 504, 505. Both ends of all the spring shafts 507, 508 are supported by the spur base 509.

Thus, all the spurs 504, 505 can be independently moved in a vertical direction (paper thickness direction), and respectively obtain pressing force against the sheet P by the spring shafts 507, 508. The spurs 504, 505 are oscillatably held by the spur base 509 through the spring shafts 507, 508. Force for pressing the sheet against the sheet discharging rollers 502, 503 by the spurs 504, 505 is weaker than force for pressing the sheet against the conveying roller 302 by the pinch roller 304.

In FIGS. 3 and 4, a spur cleaner 510 is rotatably attached to the spur base 509. This spur cleaner 510 is rotated by rotations of the spurs 504, 505 while the spur cleaner 510 abuts against both the projections 504*a,* 505*a* of the spurs 504, 505. Thus, ink and dust deposited on the spurs 504, 505 are removed therefrom, and the deposition of contact traces of the spurs 504, 505 to the sheet P is prevented.

The spur cleaner 510 is constructed of a open-cell porous member to remove the ink and the dust deposited on the spurs 504, 505 in this way so that the ink, etc. are easily absorbed into the spur cleaner. The spur cleaner 510 is attached to the spur base 509 at a suitable distance and is oscillated as the spurs 504, 505 are oscillated. However, since the spur cleaner 510 is rotated by the rotation of the spurs 504, 505, no oscillating movements of the spurs 504, 505 are regulated by the spur cleaner 510 when the spurs 504, 505 are rotated.

Press contact amounts of the spurs 504, 505 and the spur cleaner 510 are set such that a suitable press contact force having no influence on the rotations of the spurs 504, 505 is obtained. Thus, when the sheet P is discharged, the spurs 504, 505 are respectively rotated by the movement of the sheet P or the rotations of the sheet discharging rollers 502, 503, and the spur cleaner 510 is rotated by the rotations of the spurs 504, 505.

A proximal portion of the sheet discharging tray 506 is supported by an apparatus outer mounting portion (see FIG. 2), and has a suitable height from the sheet discharging roller 503 on an upstream side so as to stack plural discharged sheets P. The height of the sheet discharging tray 506 is gradually increased toward a distal end portion.

The conveying roller 302, the platen 303, the sheet discharging rollers 502, 503 and distal end portion of the sheet discharging tray 506 approximately have the same height. The sheet P is supported by such a structure in a substantial plane shape or a concave shape in which the sheet P is slightly pressed against the platen 303. Thus, upward floating of the sheet P in the recording section 401 is prevented.

The cleaning section 601 is constructed of an unillustrated pump for cleaning the recording head 402, a cap 602 for restraining drying of the recording head 402 shown in FIG. 1, and drive switching means for switching driving force from the conveying roller 302 to the feeding section 201 or the pump. This drive switching means has a drive switching arm 603 associated with the carriage 404. The drive switching arm 603 can switch to a state in which the driving force is transmitted to either the feeding section 201 or the pump, or to neither of them in accordance with a moving position of the carriage 404.

An image recording operation of the recorder 100 having such a structure will next be explained.

First, the pressure plate 202 approaches the feeding rotary member 203, and the feeding rotary member 203 is then rotated. Thus, a sheet P in an uppermost position among sheets P slantingly stacked on the pressure plate 202 is fed out. Thereafter, only the sheet P in the uppermost position is separated by a separating means and is horizontally fed to the conveying section 301.

Next, the sheet P fed to the conveying section 301 is guided by the platen 303 and the pinch roller holder 305, and is fed between the conveying roller 302 and the pinch roller 304. Thereafter, when the PE detecting means 307 detects a leading end of the conveying sheet P by the PE lever 307*a,* the sheet P is conveyed by the conveying roller 302 on the basis of this detection to a predetermined recording position. When the sheet P is pinched by the conveying roller 302 and the pinch roller 304, the feed releasing means of the feeding section 201 is operated so that the pressure plate 202 is separated from the feeding rotary member 203.

Next, when the sheet P conveyed from the conveying section 301 reaches a predetermined row position (a position of the sheet P in its conveying direction) for recording an image in the platen 303, the carriage section 403 is moved by the carriage motor 407 to a column position (a position perpendicular to the conveying direction of the sheet P) for recording the image. Thus, the recording head 402 is opposed to an image recording position. Thereafter, the recording head 402 discharges ink toward the sheet P by a signal from the electric substrate 102 so that the image is recorded to the sheet P.

In this embodiment, the above image recording per one row is repeated by desirable plural rows so that an arbitrary image is recorded on the sheet P. A trailing end of the sheet P is detected by the PE detecting means 307. Thus, the image can be recorded to a calculated trailing end position of the sheet P.

Finally, the sheet P having the image recorded in the recording section 401 is conveyed in a state in which the sheet P is nipped by the sheet discharging rollers 502, 503 and the plural spurs 504, 505, and is discharged onto the sheet discharging tray 506.

Figure 6:
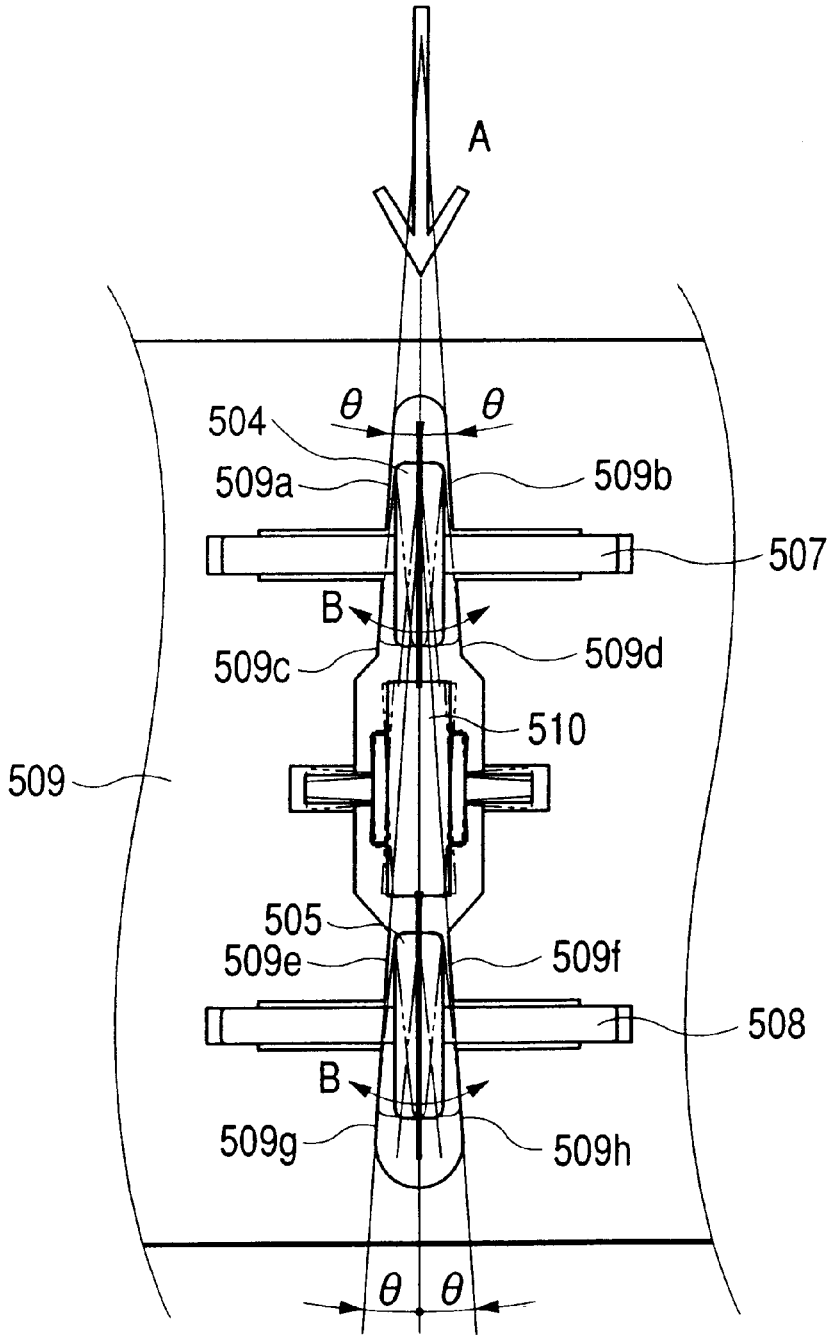
FIG. 6 is a schematic view in which a spur portion of the sheet discharging portion is seen from above the recorder.

Regulating walls 509*a* to 509*d*, 509*e* to 509*h* as regulating members are arranged in the spur base 509 for holding these spurs 504, 505. As shown in FIG. 6, the regulating walls 509*a* to 509*d*, 509*e* to 509*h* are opposingly arranged on both sides of the respective spurs 504, 505, abut against the retaining portions 504*b*, 505*b* (see FIG. 5) of the respective spurs 504, 505, and regulate movements of the spurs 504, 505 in their thrust directions and changes in attitudes of the spurs 504, 505.

In this embodiment, extending directions of the regulating walls 509*a* to 509*d*, 509*e* to 509*h* are respectively set to form a predetermined angle θ with respect to a discharging direction A of the sheet P. Thus, the distances of regulating walls 509*c* to 509*d*, 509*g* to 509*h* on a downstream side in the sheet discharging direction are gradually widened in comparison with the distances of regulating walls 509*a* to 509*b*, 509*e* to 509*f* on an upstream side in the sheet discharging direction.

In accordance with such a structure, when no rotating directions of the spurs 504, 505 are in conformity with the discharging direction A of the sheet P in discharging of the sheet, the spurs 504, 505 abut against the regulating walls 509*a*, 509*b*, 509*e*, 509*f* on the upstream side in the sheet discharging direction so that movements of these spurs in their thrust directions are regulated. Further, the spurs 504, 505 are oscillated in a direction indicated by an arrow B around points upstream of pressing points against the sheet P in the sheet discharging direction by the assistance of force from contact portions (contact points) with the sheet P located downstream of abutting portions of the spurs on these regulating walls.

Namely, when no rotating directions of the spurs 504, 505 are in conformity with the discharging direction A of the sheet P, the spurs 504, 505 abut against the regulating walls 509*a*, 509*b*, 509*e*, 509*f* upstream of the contact portions with the sheet P in the sheet discharging direction. Thus, the spurs 504, 505 can be oscillated by the conveying force of the sheet P in a state in which the points upstream of the contact portions with the sheet P in the sheet discharging direction are set to oscillation centers.

Thus, the spurs 504, 505 can be changed to attitudes in which the rotating directions (rolling directions) of these spurs are in conformity with the discharging direction A of the sheet P. Accordingly, the rotating directions of the spurs 504, 505 are conformed to the discharging direction A of the sheet P in accordance with the movement of the sheet P by an attitude changing means constructed of the spur base 509 and the regulating walls 509*a* to 509*d*, 509*e* to 509*h*. Thus, it is possible to prevent the tips of the projections 504*a*, 504*b* of the spurs 504, 505 from being deviated in a direction perpendicular to the discharging direction A of the sheet P after these tips come in contact with the printing surface and before the tips of the projections 504*a*, 504*b* of the spurs 504, 505 are separated from the printing surface of the sheet P.

Thus, the sheet can be conveyed and discharged without separating any ink receiving layer on the printing surface and damaging the spurs even when coated paper having a weak surface layer is particularly printed. As a result, an image of good quality can be obtained.

In the above explanation, the spurs 504, 505 are oscillated by gradually increasing the distance between the regulating walls 509*a* to 509*d*, 509*e* to 509*h* from the upstream side to the downstream side in the discharging direction A of the sheet. However, a dedicated oscillation member may be separately arranged, and the spurs 504, 505 may be also rotatably attached to this oscillation member.

A second embodiment of the present invention will next be explained.

Figure 7:
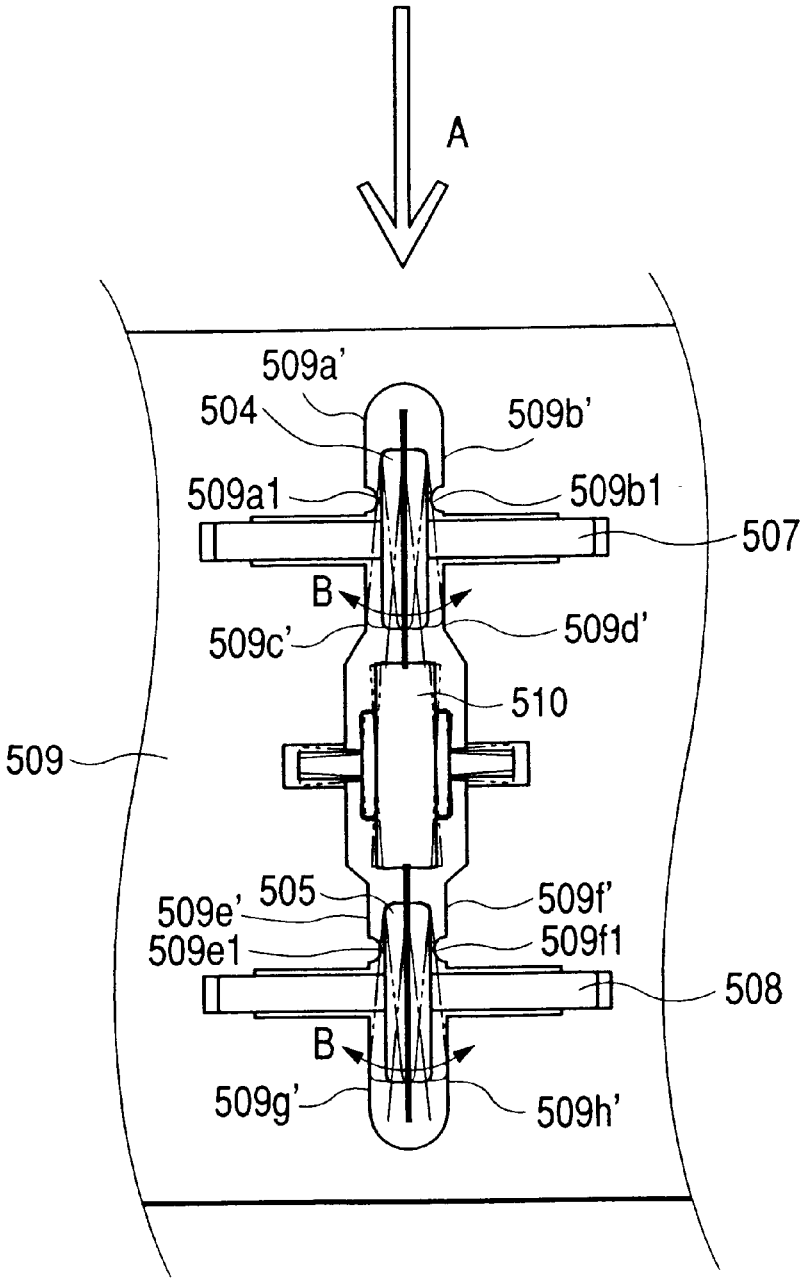
FIG. 7 is a schematic view in which a spur portion of a sheet discharging portion of a recorder in accordance with a second embodiment of the present invention is seen from above the recorder.

FIG. 7 is a typical view in which a spur portion of the sheet discharging section of a recorder in accordance with this embodiment is seen from above the recorder. In FIG. 7, the same reference numerals as in FIG. 6 designate the same or corresponding portions.

In FIG. 7, regulating walls 509*a*' to 509*d*', 509*e*' to 509*h*' are formed in a spur base 509. Each of these regulating walls 509*a*' to 509*d*', 509*e*' to 509*h*' is formed approximately parallel with the discharging direction A of the sheet P.

Further, projecting portions 509*a*1, 509*b*1, 509*e*1, 509*f*1 are respectively projected toward the spurs 504, 505 from regulating walls 509*a*', 509*b*', 509*e*', 509*f*' upstream of centers of the spurs 504, 505 in the sheet discharging direction A. These projecting portions 509*a*1, 509*b*1, 509*e*1, 509*f*1 abut against retaining portions 504*b*, 505*b* of the respective spurs 504, 505 so that movements of the respective spurs 504, 505 in their thrust directions and changes in attitudes caused by these movements are regulated.

In accordance with such a structure, similar to the first embodiment, when no rotating directions of the spurs 504, 505 are in conformity with the discharging direction A of the sheet P, the respective spurs 504, 505 are oscillated such that their rotating directions are in conformity with the discharging direction A of the sheet P. Therefore, the sheet P can be conveyed and discharged without forming any spur trace.

Further, in this structure, the projecting portions 509*a*1, 509*b*1, 509*e*1, 509*f*1 abut against portions near rotation centers of the respective spurs 504, 505. Therefore, sliding resistance against the rotation of each of the spurs 504, 505 is reduced, and the spurs 504, 505 smoothly follow the movement of the sheet P. As a result, spur trace preventing effects of the sheet P can be further expected.

Figure 8:
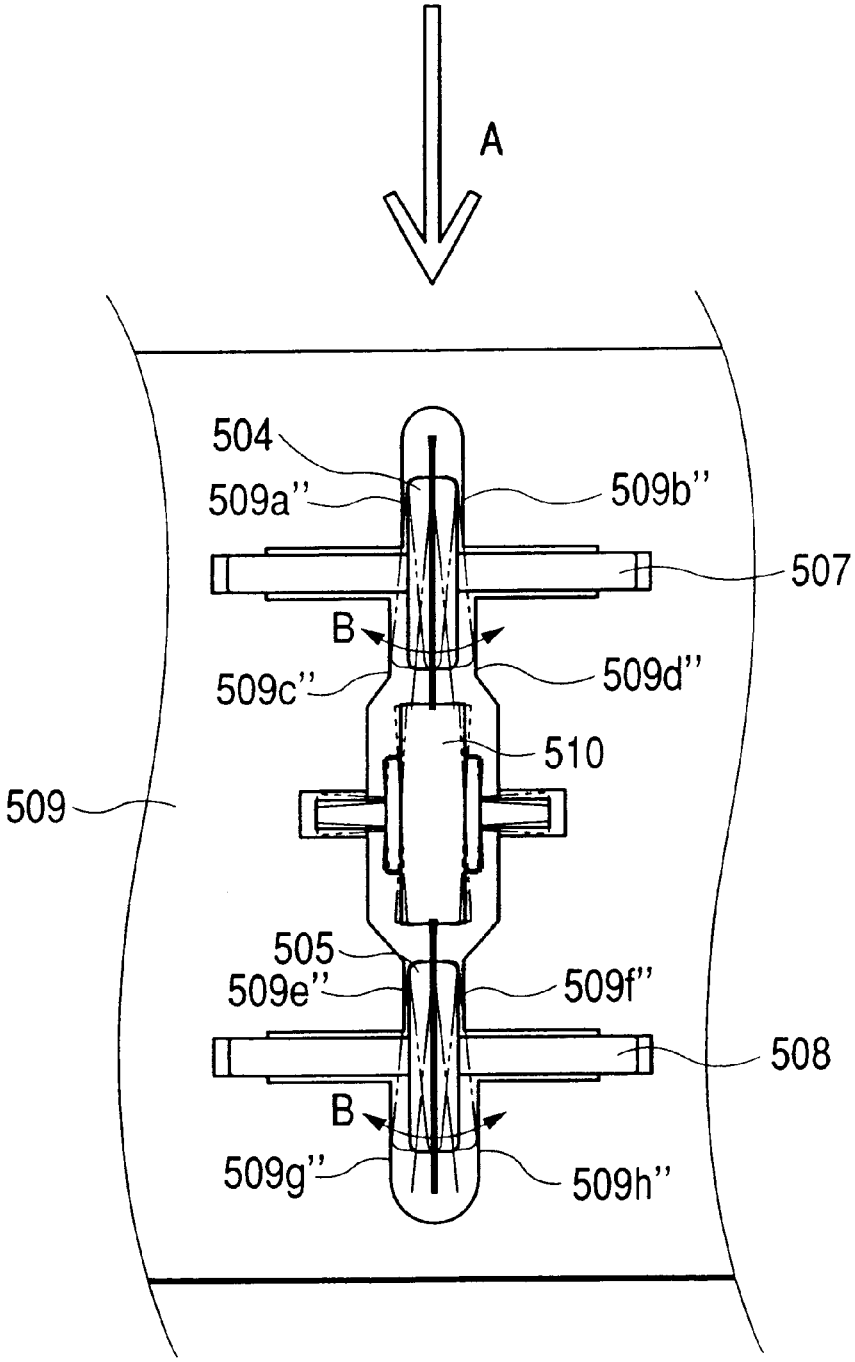
FIG. 8 is a schematic view in which a spur portion of a sheet discharging portion of a recorder in accordance with a third embodiment of the present invention is seen from above the recorder.
Figure 9:
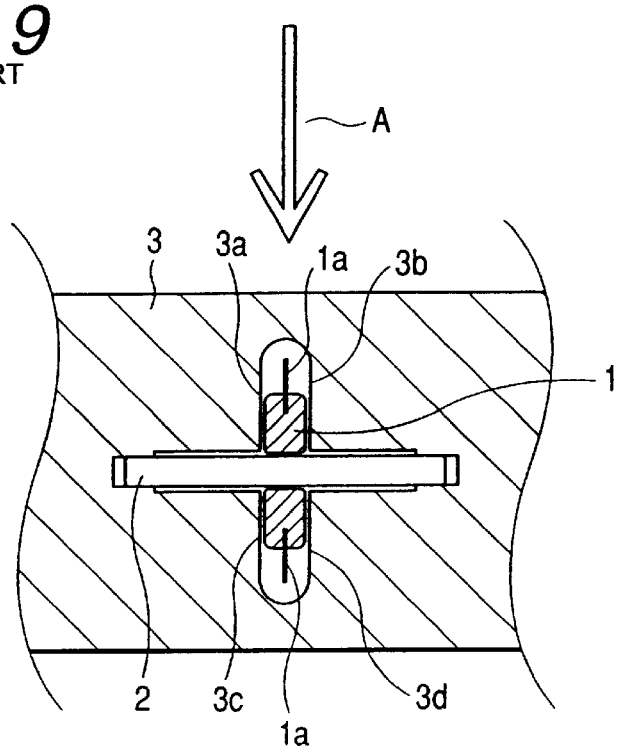
FIG. 9 PRIOR ART
FIG. 9 is a view showing an attaching state of a spur of a conventional sheet discharging apparatus.
Figure 10:
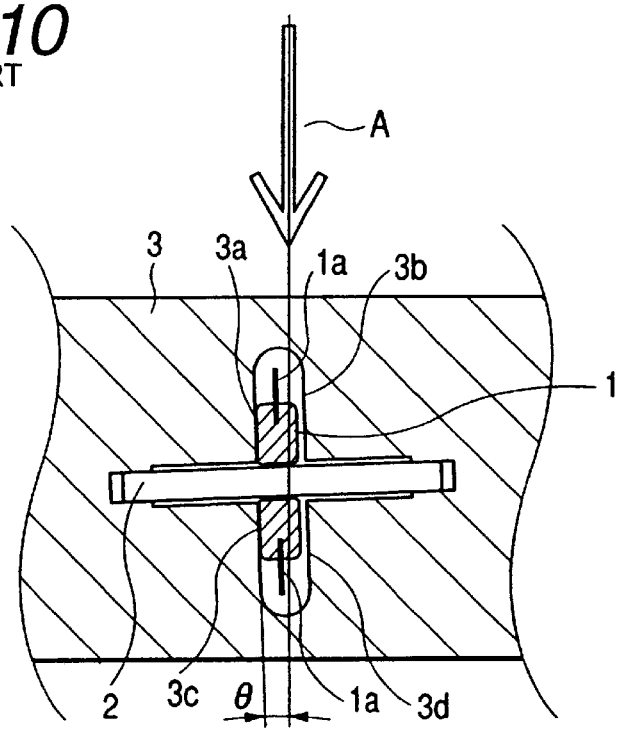
FIG. 10 PRIOR ART
FIG. 10 is a view showing a state in which a rotating direction of the spur is deviated from a sheet conveying direction by a deviation in a thrust regulating wall.
Figure 11:
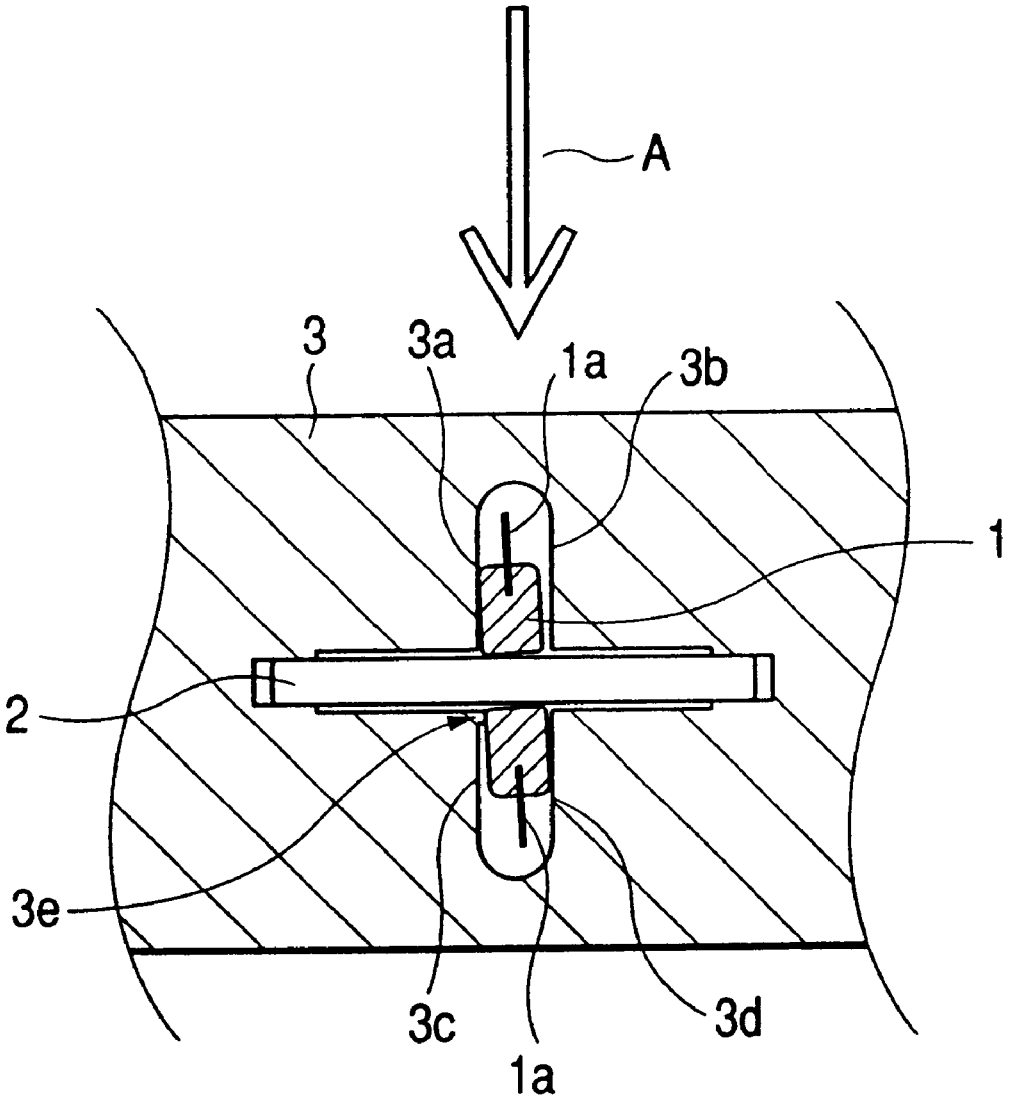
FIG. 11 PRIOR ART
FIG. 11 is a view showing a state in which the rotating direction of the above spur is deviated from the sheet conveying direction by a projecting portion caused in the thrust regulating wall.

FIG. 8 is a schematic view in which a spur portion of the sheet discharging section of a recorder in accordance with a third embodiment of the present invention is seen from above the recorder. In this embodiment, as shown in FIG. 8, each of regulating walls 509*a*" to 509*d*", 509*e*" to 509*h*" is formed on a plane approximately parallel to the discharging direction A of the sheet P. Further, the distances between regulating walls 509*c*" and 509*d*", 509*g*" and 509*h*" on a downstream side from centers of the spurs 504, 505 in the sheet discharging direction A are widened in comparison with the distances between regulating walls 509*a*" and 509*b*", 509*e*" and 509*f*" on an upstream side from these centers.

In accordance with such a structure, when no rotating directions of the spurs 504, 505 are in conformity with the discharging direction A of the sheet P, the respective spurs 504, 505 are oscillated such that their rotating directions are in conformity with the discharging direction A of the sheet P. Therefore, the sheet P can be conveyed and discharged without forming any spur trace.

As explained above, in accordance with the present invention, when a rotary member is rotated while pressing against the sheet, an orientation of the rotary member is changed by attitude changing means in accordance with a movement of the sheet. Thus, a rotating direction of the rotary member can be conformed to the discharging direction of the sheet. Accordingly, the sheet can be discharged without causing any spur trace on the surface of coated paper having a relatively weak surface layer, etc.

What is claimed is:

1. A sheet discharging apparatus for discharging a sheet having an image formed thereon to a sheet discharging section, said apparatus comprising:

sheet discharging means for discharging said sheet to said sheet discharging section;

a rotary member having a plurality of projections formed on an outer circumferential portion thereof, said rotary member being rotated by a movement of said sheet discharging means while pressing said sheet by said projections; and attitude changing means that changes an orientation of said rotary member in accordance with a movement of the sheet so that, when said rotary member is rotated while pressing the sheet, a rotating direction of said rotary member is in conformity with a discharging direction of the sheet, wherein said attitude changing means includes a retaining member for oscillatably retaining said rotary member, and regulating members, which are opposingly arranged on both sides of said rotary member, for regulating an axial movement of said rotary member by abutting against said rotary member, and wherein, in order that an oscillation center of said rotary member is located upstream of a contact point of said rotary member with the sheet in the sheet discharging direction, a distance between said regulating members opposingly arranged is gradually increased from an upstream side to a downstream side in the sheet discharging direction so that said regulating members can abut against said rotary member upstream of a contact point of said rotary member with the sheet in the sheet discharging direction.

2. A sheet discharging apparatus according to claim 1, comprising an elastic shaft, wherein said rotary member is rotated about said elastic shaft as a center, and is oscillatably retained to said retaining member with said elastic shaft.

3. A sheet discharging apparatus according to claim 1, wherein said attitude changing means includes an oscillation member for rotatably retaining said rotary member.

4. An image forming apparatus comprising:

an image forming section; and a sheet discharging apparatus for discharging a sheet having an image formed in said image forming section to a sheet discharging section, said sheet discharging apparatus being one as recited in any one of claims 1, 2, or 3.

5. An image forming apparatus according to claim 4, wherein, in said image forming section, the image is formed on the sheet by use of a recording head for discharging ink.

6. An image forming apparatus for forming an image on a sheet, comprising:

a first rotary member for conveying the sheet;

a second rotary member being disposed opposite to said first rotary member and being rotated by a rotation of said first rotary member so that said first rotary member and said second rotary member pinch the sheet therebetween to convey the sheet, said second rotary member being rotated along a moving direction of the conveying sheet,;

a supporting member for supporting said second rotary member to enable a displacement with respect to an orientation of said second rotary member in a direction perpendicular to a conveying direction of the sheet along a surface of the sheet; and a regulating member for regulating the displacement with respect to the orientation of said second rotary member so that a displaceable amount of said second rotary member at its end downstream in the conveying direction of the sheet is larger than a displaceable amount of said second rotary member at its end upstream in the conveying direction of the sheet.

7. An image forming apparatus according to claim 6, wherein said second rotary member has a plurality of projections formed on an outer circumferential portion thereof, said second rotary member being to be rotated while pressing the sheet against said first rotary member by said projections.

8. An image forming apparatus according to claim 6, further comprising conveying means for conveying the sheet, said conveying means being arranged upstream of said first rotary member in the conveying direction of the sheet.

9. An image forming apparatus according to claim 8, wherein said conveying means includes a conveying roller for conveying the sheet and a pinch roller for pressing the sheet against said conveying roller.

10. An image forming apparatus according to claim 9, wherein a peripheral speed of said first rotary member is higher than a peripheral speed of said conveying roller.

11. An image forming apparatus according to claim 10, wherein said first rotary member conveys the sheet while being slipped with respect to the sheet.

12. An image forming apparatus according to claim 11, wherein a force for pressing the sheet against the conveying roller by said pinch roller is larger than a force for pressing the sheet against said first rotary member by said second rotary member.

13. An image forming apparatus according to claims 6 or 11, wherein, when said second rotary member is rotated while pressing the sheet, the orientation of said second rotary member is changed in accordance with the moving direction of the sheet.

14. An image forming apparatus according to claim 6, wherein the image is formed on the sheet by use of a recording head for discharging ink.

* * * * *

UNITED STATES PATENT AND TRADEMARK OFFICE

CERTIFICATE OF CORRECTION

PATENT NO. : 6,457,888 B1
DATED : October 1, 2002
INVENTOR(S) : Toshiya Matsumoto It is certified that error appears in the above-identified patent and that said Letters Patent is hereby corrected as shown below:

Title page,
Item [57], ABSTRACT,
Line 16, “coincide” should read -- to coincide --.

Column 2,
Line 9, “coping” should read -- copying --.
Line 56, “is” (2nd occurrence) should be deleted.
Line 57, “in conformity” should read -- conforms --.
Line 61, “is perfectly in” should read -- perfectly --.
Line 62, “conformity” should read -- conforms --.

Column 3,
Line 23, “is in conformity” should read -- conforms --.

Column 4,
Line 44, “coincide” should read -- to coincide --.

Column 5,
Line 20, “attaching” should read -- attached --.

Column 6,
Line 22, “4guide” should read -- guide --.
Line 52, “in” should be deleted.

Column 7,
Line 58, “a” should read -- an --.

Column 9,
Line 52, “are in conformity” should read -- conform --.

UNITED STATES PATENT AND TRADEMARK OFFICE

CERTIFICATE OF CORRECTION

PATENT NO. : 6,457,888 B1
DATED : October 1, 2002
INVENTOR(S) : Toshiya Matsumoto It is certified that error appears in the above-identified patent and that said Letters Patent is hereby corrected as shown below:

Column 10,
Line 33, “are in conformity” should read -- conform --.
Line 35, “are in conformity” should read -- conform --.
Line 59, “are in conformity” should read -- conform --.
Line 59, “are in conformity” should read -- conform --.
Line 61, “are” should be deleted.
Line 62, “in conformity” should read -- conform --.

Column 12,
Line 10, “sheet,;” should read -- sheet; --.
Line 26, “to be” should be deleted.

Signed and Sealed this

Eighteenth Day of March, 2003

JAMES E. ROGAN
*Director of the United States Patent and Trademark Office*